United States Patent [19]

Sakcriska

[11] 4,392,332

[45] Jul. 12, 1983

[54] ICE SKATE SHARPENER

[75] Inventor: Glenn Sakcriska, Ypsilanti, Mich.

[73] Assignee: Canadian Skate Contours, Ltd., Mississauga, Canada

[21] Appl. No.: 275,794

[22] Filed: Jun. 22, 1981

Related U.S. Application Data

[60] Continuation of Ser. No. 70,408, Aug. 27, 1979, Pat. No. 4,294,043, which is a division of Ser. No. 869,696, Jan. 16, 1978, Pat. No. 4,172,343, which is a continuation-in-part of Ser. No. 745,362, Nov. 26, 1976, Pat. No. 4,069,620.

[51] Int. Cl.[3] ..... B24B 9/04

[52] U.S. Cl. ..... 51/92 BS; 51/100 R; 51/228; 269/303

[58] Field of Search ..... 51/92 R, 92 BS, 100 R, 51/228, 281 R, 281 C; 76/83; 33/174 R, 494; 409/93, 110, 130; 269/303, 315, 319

[56] References Cited

U.S. PATENT DOCUMENTS

| | | | |
|---|---|---|---|
| 1,907,213 | 5/1933 | Parnell | 51/228 |
| 2,655,774 | 10/1953 | Fleming | 51/228 |
| 3,040,481 | 6/1962 | De Vlieg | 51/100 |
| 3,789,551 | 2/1974 | Norris et al. | 51/228 X |
| 3,839,828 | 10/1974 | Arnold | 51/100 R |
| 3,988,124 | 10/1976 | Babcock | 51/228 X |
| 4,055,026 | 10/1977 | Zwicker | 51/228 |
| 4,294,043 | 10/1981 | Sakcriska | 51/100 R |

*Primary Examiner*—James L. Jones, Jr.
*Assistant Examiner*—Robert P. Olszewski
*Attorney, Agent, or Firm*—James M. Deimen

[57] ABSTRACT

The invention comprises an improved ice skate grinding, sharpening and contouring machine. The machine includes pins mounted in movable blocks to accurately center an ice skate between the heel and sole struts in a movable holding fixture and alternate eccentric pin positions to select the best contour location on the blade as a function of intended skate usage. As an example, the best blade contour for a hockey forward requires a deeper grind below the forward strut than the contour for a hockey defenseman. The centering feature assures that the skate contour desired will be accurately ground onto the blade and pitched forward the desired amount. An eccentrically mounted pin to adjust the blade position relative to the blade holding fixture for pitching is disclosed in one embodiment. In an alternative embodiment the entire fixture is pitched relative to the fixture follower rollers. Figure skates can be advantageously centered and pitched as desired with the invention for accommodating the particular requirements of the figure skater.

New hockey skates with unconventional molded plastic struts such as the Canadian TUUK 2000 have entered commerce. Such skates are accommodated by a modified method of determining the blade center location that is equivalent to the center location of a hockey skate with conventional struts. The modified method and apparatus utilize modified pins or a notched clamping jaw either of which engage one plastic blade clamping lip adjacent the skate blade to locate the blade in the fixture.

3 Claims, 14 Drawing Figures

FIG.6
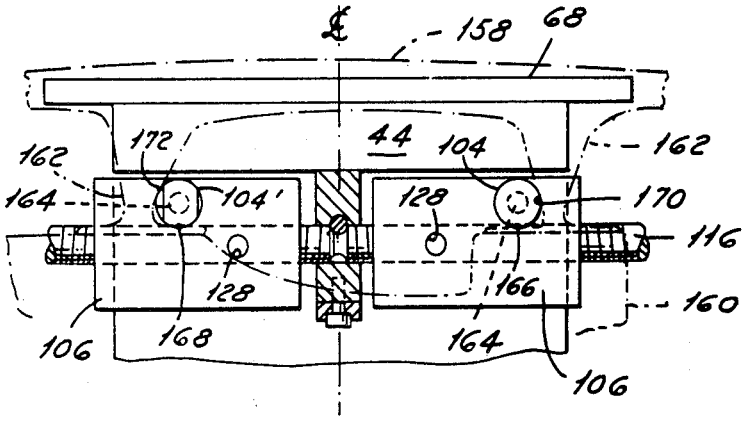
FIG.7
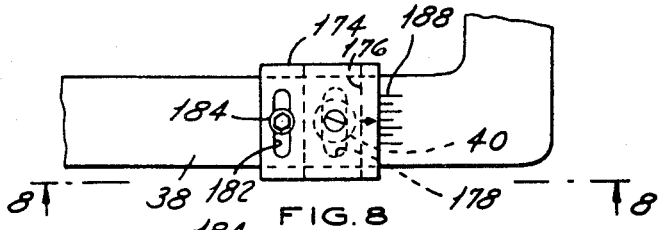
FIG.8
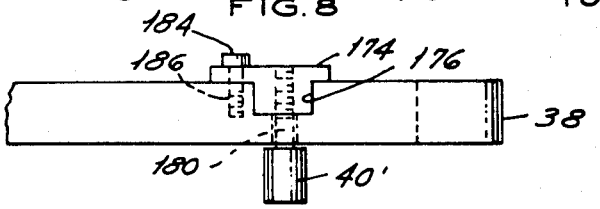
FIG.9
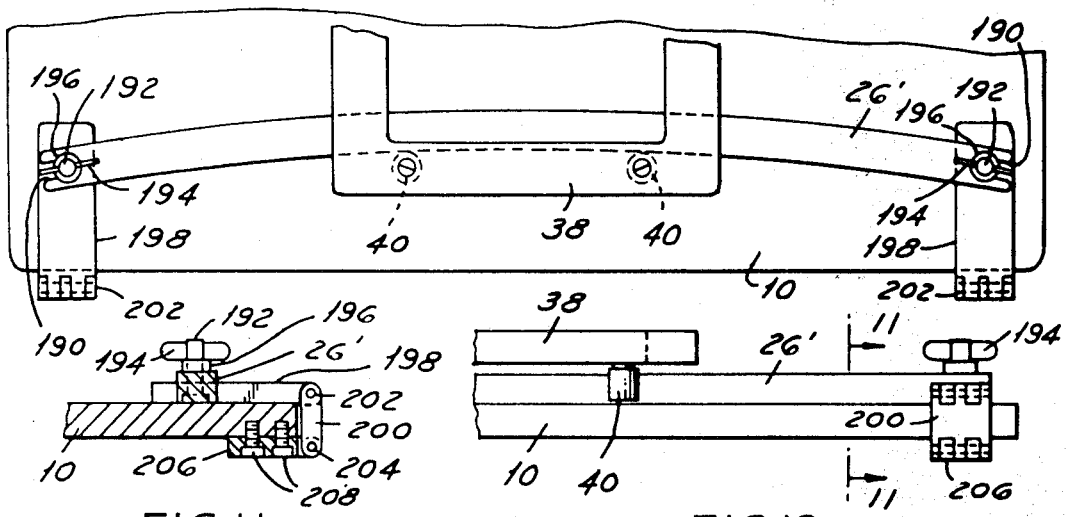
FIG.11
FIG.10

ICE SKATE SHARPENER

This application is a continuation of co-pending application Ser. No. 070,408, filed Aug. 27, 1979, now issued U.S. Pat. No. 4,294,043, dated Oct. 13, 1981, which is a division of application Ser. No. 869,696, filed Jan. 16, 1978, now issued U.S. Pat. No. 4,172,343, dated Oct. 30, 1979, in turn a continuation-in-part of application Ser. No. 745,362, filed Nov. 26, 1976, now issued U.S. Pat. No. 4,069,620, dated Jan. 24, 1978.

BACKGROUND OF THE INVENTION

The invention is in the field of ice skate sharpening and relates to machines for sharpening skates in a reproducible and accurate manner. Such machines are exemplified by U.S. Pat. Nos. 1,907,213, 3,719,006 and 3,839,828.

Where a specific blade contour is desired, template or cam following machines have been developed and are exemplified by U.S. Pat. Nos. 3,040,481 and 3,789,551. Such machines, while providing contouring capability as a function of the cam or template profile selected, do not incorporate means to longitudinally center the skate between the heel and sole struts in a convenient and reproducible manner. For best skate performance, the skate blades should be contoured and pitched about the centerline between the struts for the skater's intended use. Thus, a hockey defenseman's skate has a contour different from a hockey forward's skate and both are different from a goalie's skate. The particular contours and pitches must be reproducible when the skates are resharpened or replaced with new skates.

SUMMARY OF THE INVENTION

The invention comprises an improved ice skate grinding, sharpening and contouring machine and utilizes a flat bed plate having a rotatable motor powered arbor mounted grinding wheel thereon. An ice skate is clamped in a fixture that is slideable on the flat bed. The fixture includes cam follower means adapted to engage a cam or template, sometimes known as a radius bar, removably affixed to the flat bed. With the skate clamped in the fixture, the fixture is manually guided by the grinding wheel with the cam follower means in engagement with the cam.

The novel improvements include a pair of dowels extending upwardly in parallel from separate blocks. The blocks engage a single horizontal screw with right and left hand threads, thereby permitting the blocks to be simultaneously adjusted in opposite directions perpendicular to the axes of the dowels. In centering a hockey skate the dowels are separated until they simultaneously engage both struts and the tubular blade holder. The blade can then be clamped tightly to the fixture.

The dowels are movable to alternative locations on the blocks more suitable for figure skates which do not have the tubular clamp and strut configuration. The dowels are then adjusted to simultaneously contact the struts and heel and sole plates of the blades for centering and alignment.

Optionally, one dowel is rotatably adjustable and eccentrically mounted or provided with several different effective radii. Selection of an appropriate dowel radius determines the depth of grind on the forward portion of the blade relative to the rear portion of the blade. Thus, accurately ground and contoured blades, pitched forward to the degree desired, can be produced and reproduced with the invention. In an alternative embodiment the cam follower means can be adjusted to pitch the entire fixture and skate relative to the cam to provide the forward pitch desired.

New types of hockey skates with unconventional molded plastic struts, such as the TUUK 2000 manufactured by TUUK SPORTS LTD., 2890 Sabourin, Ville St. Laurent, Province de Quebec, Canada H4S 1M2, require a modified fixture and a modified method of determining the blade center location equivalent to the center location of a hockey skate with conventional struts. The modified fixture includes special pins to accommodate the skate. A special scale is provided to locate the blade center a specified distance from the back of the blade. Thus, such skates as the TUUK 2000 can be centered and pitched on the fixture disclosed in the parent application with the modifications and method disclosed in this application.

DESCRIPTION OF THE DRAWINGS

FIG. 6 is a partial cutaway plan view of the dowel blocks with a partial figure skate superimposed thereon;

FIG. 7 is a partial plan view of an alternative means for pitching a skate blade for grinding;

FIG. 8 is a view of the optional pitching means taken along the line 8—8 in FIG. 7;

FIG. 9 is a partial plan view of an optional cam retaining means;

FIG. 10 is a partial end view of the optional cam retaining means of FIG. 9;

FIG. 11 is a cutaway view of the optional cam retaining means of FIG. 9 taken along the line 11—11 of FIG. 10;

DESCRIPTION OF THE PREFERRED EMBODIMENTS

Figure 1:
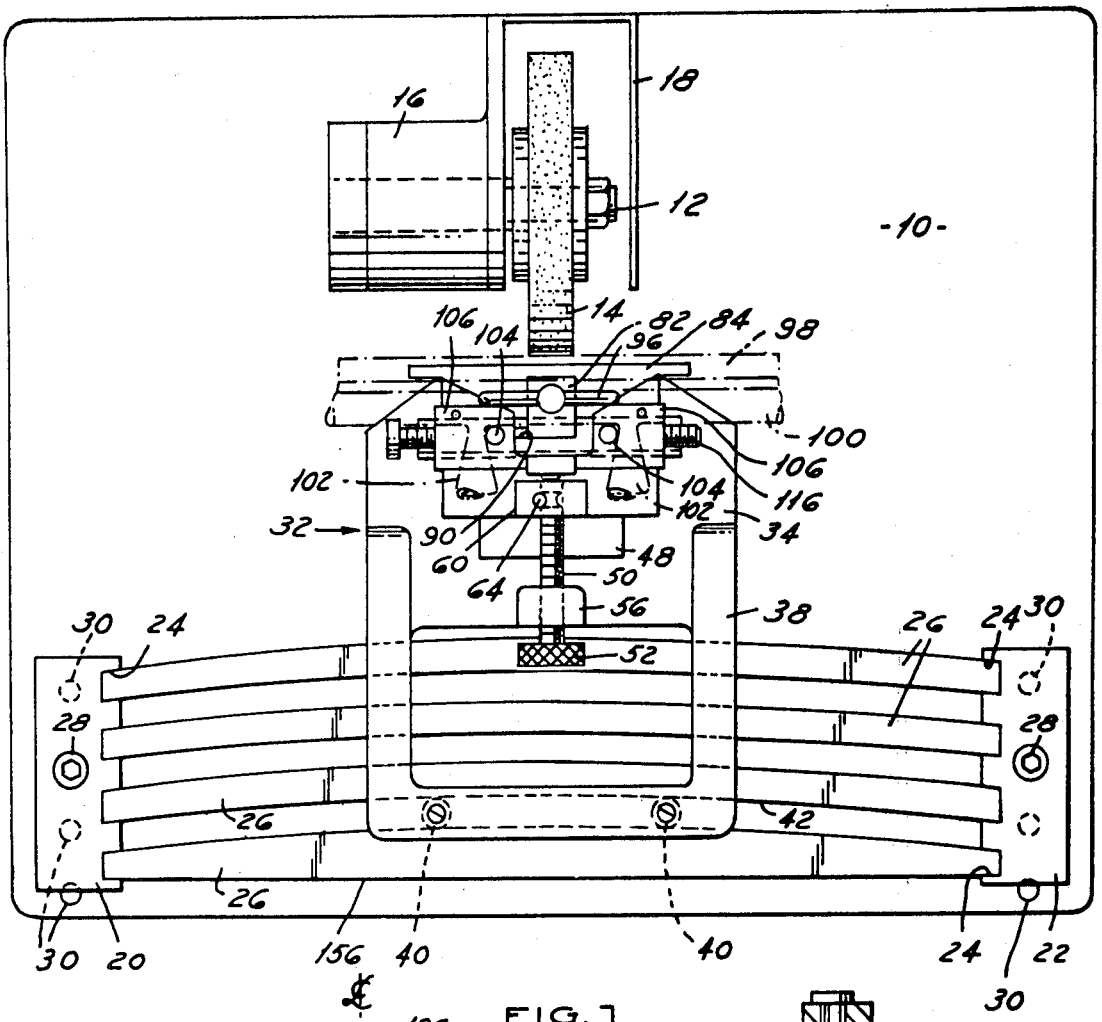
FIG. 1 is a plan view of the skate sharpening machine with a partial hockey skate blade superimposed thereon.

In FIG. 1 the skate sharpening machine comprises a flat bed plate 10 having mounted thereon a rotatable grinding wheel arbor 12 and a grinding wheel 14. The arbor 12 is mounted in a covered support 16 with a dust cover 18 thereattached and extending partially about the grinding wheel 14. The covered support 16 may enclose a direct drive grinding wheel or an arbor pulley and a belt extending through a hole in the bed plate 10 to a motor located thereunder. Both above grinding wheel arbor drive means are well known in the art and therefore not shown.

Removably attached to the bed plate 10 are a pair of opposed cam or template retainers 20 and 22 each having a plurality of notches 24 adapted to retain one or more cams or templates 26. Although four cams 26 are shown in FIG. 1 only the single cam selected for a particular skate need be in the cam retainers 20 and 22. Each of the cam retainers 20 and 22 is fastened to the bed plate 10 with a single socket head screw 28 or similar means. The bed plate includes several threaded holes 30 suitably spaced in parallel relationship at either side of the bed plate 10. The cam retainers 20 and 22 and cams 26 can be shifted as a whole toward or away from the grinding wheel 14 to select a different skate contour as desired or individual cams 26 can be removed and reinserted in notches 24 as desired.

Figure 2:
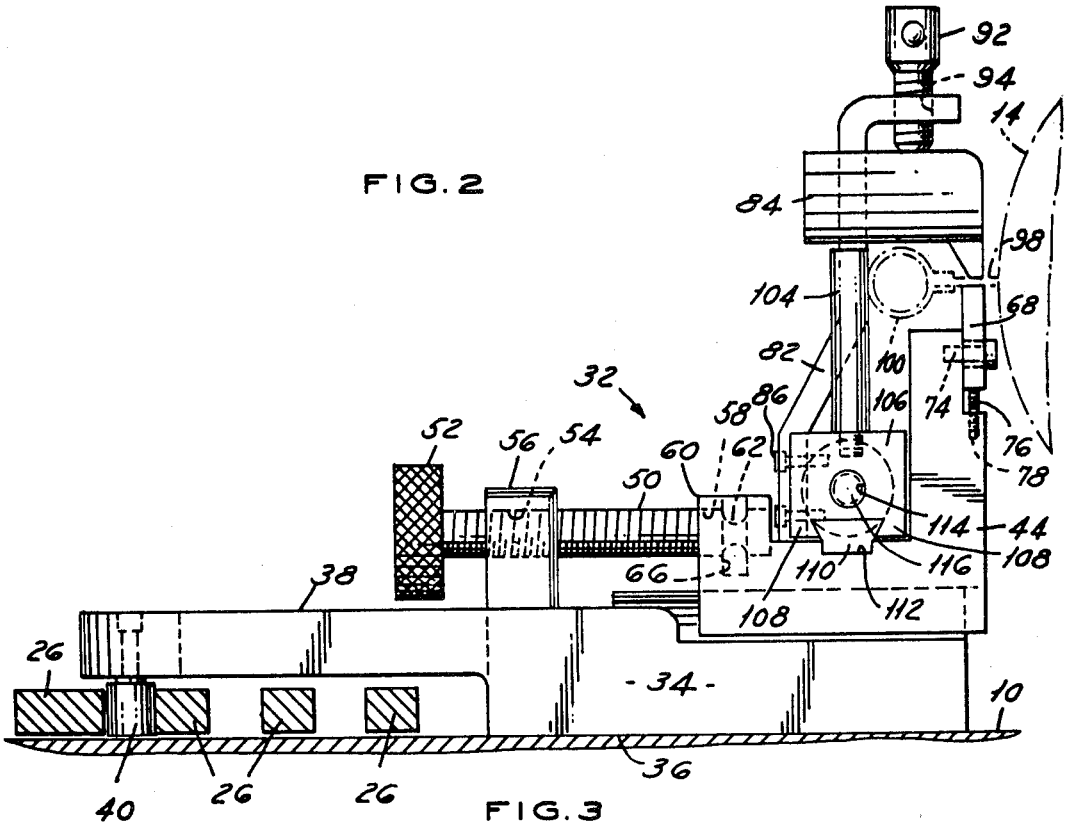
FIG. 2 is a partial side view of the skate sharpening machine.
Figure 3:
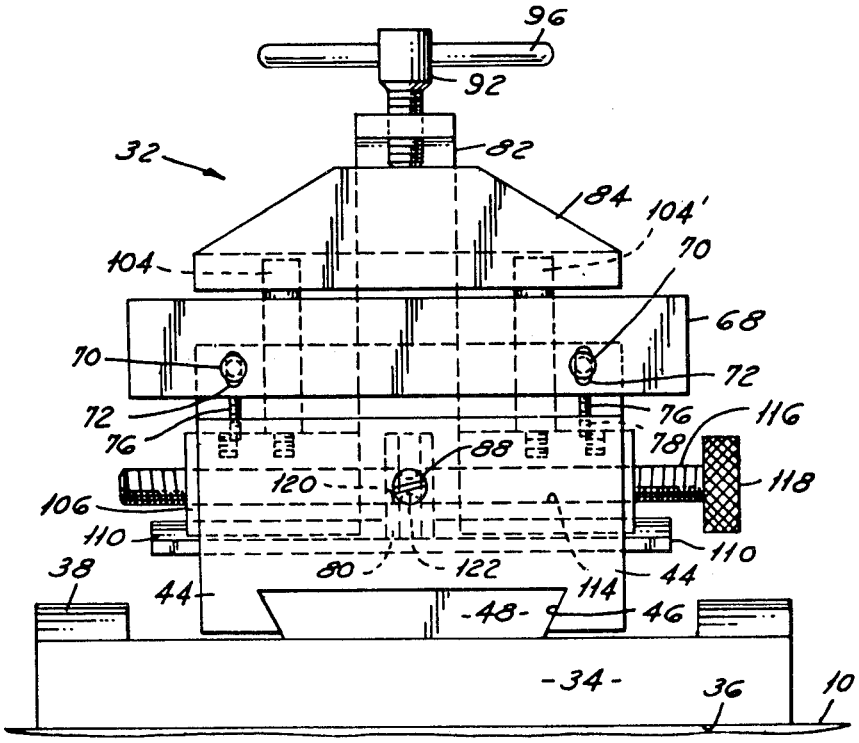
FIG. 3 is a partial front view of the skate sharpening machine.

In FIGS. 1, 2 and 3 a skate holding fixture generally denoted by 32 rests upon a bed plate 10. The base 34 of the fixture 32 includes a smooth bottom surface 36 and a raised handle portion 38. Depending from the raised handle 38 are a pair of roller cam followers 40 adapted to engage a cam contour surface 42. Mounted on the base 34 is a lower clamping jaw support 44 having dove tail rails 46 adapted to engage a dovetail rail 48 on the base 34. An adjustment screw 50 having a knurled knob 52 engages a threaded bore hole 54 in an upstanding portion 56 integral with the base 34. The end of the screw 50 extends into a borehole 58 located in an upstanding portion 60 of the support 44. The screw 50 includes a circumferential neck 62 adapted to slideably engage an off center pin 64 in turn tightly fitted in a hole 66 in the portion 60. Rotation of the screw 50 causes the support 44 to slideably move on the dovetail rail 48 relative to the base 34 and thereby provide horizontal skate adjustment means on the fixture perpendicular to the axis of rotation of the grinding wheel 14.

Attached to the support 44 is a lower jaw 68. The attachment means for the lower jaw 68 comprises socket head screws 70 engaging the lower jaw 68 through oblong holes 72 and engaging the support 44 in threaded holes 74. Beneath the lower jaw 68 are twin vertical adjustment screws 76 for setting the elevation of the jaw above the bed plate 10. The screws 76 engage threaded holes 78 in the support 44 and bear upon the underside of the jaw 68.

Centrally located on the support 44 is a block 80 having an arm 82 extending upwardly and over an upper clamping jaw 84. As best shown for clarity in FIG. 4 the arm 82 is fastened to the block 80 with socket head screws 86 and the block 80 in turn is fastened to the support 44 with countersunk flat head screws 88. The clamping jaw 84 is slotted at 90 to provide a fulcrum engagement with the arm 82. A threaded clamping screw 92 engages the arm 82 through a threaded hole 94 and bears upon the upper surface of the clamping jaw 84. A handle 96 completes the clamping screw 92.

Figure 4:
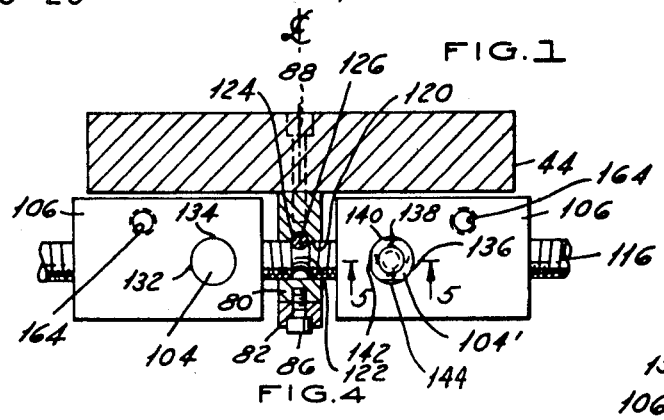
FIG. 4 is a partial cutaway plan view of the dowel blocks.

As shown ghosted in FIGS. 1 and 2 a hockey or racing skate is clamped with the blade 98 inserted between the jaws 68 and 84 at the proper vertical elevation above the bed plate 10 as determined by the vertical adjustment screws 76. Hockey skates are conventionally made with a clamp tube 100 extending substantially the length of the blade 98 and struts 102 supporting the shoe portion (not shown). The skate is centered horizontally in the fixture 32 by vertically extending dowels 104 mounted in turn on dowel blocks 106. The dowel blocks 106 include dovetail rails 108 in engagement with dovetail guide rails 110 in turn mounted in a channel 112 in the support 44. The dowel blocks 106 each include a co-axial borehole 114, one of which has a right hand thread and the other a left hand thread adapted to engage a long screw 116 having matching right and left hand threads. The screw 116 includes a knurled knob 118 and passes through an unthreaded borehole 120 in the block 80. A narrow neck 122 on the screw 116 slideably engages a pin 124 inserted in a vertical borehole 126 in the block 80 as best shown in FIG. 4. As is best shown in FIG. 1, before the blade 98 is tightly clamped, rotation of the screw 116 to increase the distance between the dowels 104 until each contact both the upper surface of the skate clamp tube 100 and a strut 102 assures that the skate is properly centered in the fixture 32. The blade 98 is thereby accurately and reproducibly located lengthwise relative to the contour cam selected when the cam follower rollers are in contact with the cam surface 42.

Figure 5:
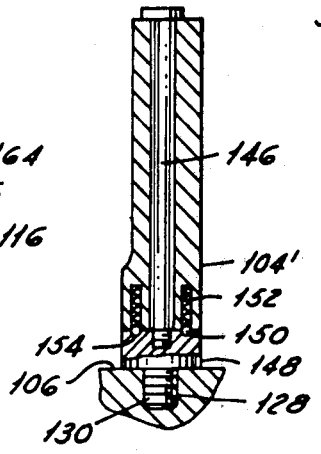
FIG. 5 is a partial cutaway view of an optional adjustable pitching dowel taken along the line 5—5 of FIG. 4.

In FIGS. 1, 2 and 3 two identical dowels 104 are shown. Optionally, as shown in FIGS. 4 and 5 a standard dowel 104 is located on the left most dowel block 106 and an alternative adjustable dowel 104' is mounted on the right most dowel block 106. Each dowel block 106 includes a threaded socket 128 adapted to engage a threaded stud 130 on either a standard dowel 104 or alternative dowel 104'. The standard dowel 104 on the left contacts the skate front strut 102 at 132 and the clamp tube 100 at 134 with the toe of the skate blade 98 to the left. Either a standard dowel 104 or the adjustable dowel 104' shown contacts the rear strut at 136 for proper centering of the skate. The adjustable dowel 104', however, contacts the clamp tube 100 at 138 with one of the four differing selectable radii as measured from the axis of the dowel. Preferably, one of the radii is equal to the standard dowel 104 radius and the other three radii are sequentially incrementally smaller. The smaller radii can be formed by flats 140, 142 and 144 on dowel 104' or an eccentrically mounted dowel can be used. The adjustable dowel 104' includes a central headed pin 146 threaded tightly into a base 148, the base 148 in turn having a threaded stud 130 for engagement with a dowel socket 128 as shown in FIG. 5. At least one ball detent 150 and spring 152 within the lower end of the dowel 104' is engageable with sockets 154 in the base 148 to retain the dowel 104' in the position selected.

Selection of one of the flats 140, 142 or 144 causes the forward portion of the blade 98 (toward the left) to be ground more than the rear portion. This pitching of the skate blade pitches the skater forward thereby improving the novice's skating posture by causing his knees to bend and hips to unlock. Some pitching is preferred by a hockey forward to provide quickness in cutting. In contrast, a hockney defenseman prefers the blade ground with the curved cam contour desired but without the pitching. Typically, the flats provide 1/32", 1/16" and 3/32" decreases in radius of the dowel 104' relative to the unflatted fourth position. Goalie skates and speed skates are preferably ground straight over substantially the entire blade length. One cam contour 156 is provided for such skates. The other cam contours may have circular radii of curvature typically of nine to eleven feet. Cam contours are not limited to circular arcs but may have other curves or straight portions as desired.

In FIG. 6 a portion of a figure skate blade 158 and boot 160 is shown ghosted in proper position resting on the lower jaw 68. The struts 162 and blade 158 are of integral construction and so formed that alternate means of centering the skate relative to the struts are required. The dowels 104 are mounted in alternate sockets 164 in the dowel blocks 106. The screw 116 is rotated as above to center the skate in the fixture, however, the dowels contact the heel plate at 166 and sole plate at 168 of the skate 160. The rear strut is contacted at 170 and front strut at 172 with the toe of the skate to the left. With the skate in contact at all four points on the dowels 104, the blade 158 can be clamped tightly and accurately in the fixture 32 about the centerline between the struts 162. This centering means allows figure skates as well as hockey skates to be accurately centered and ground. Screws in the heel and sole plates of some figure skates may have to be removed temporarily for accurate locating in the fixture 32. The adjustable dowel 104' is shown in FIG. 6 located in the left socket 164 for pitching the blade 158 forward as desired when grinding a figure skate clamped with the toe to the left.

In FIGS. 7 and 8 an alternative means for adjusting the pitch of a skate is disclosed. Rather than pitch the skate in the fixture 32, the entire fixture is pitched by adjusting the position of a cam follower 40' relative to the handle portion 38. The cam follower 40' depends from a block 174 which is slideably adjustable in a slot 176 traversing the handle 38. An oblong through hole 178 accommodates the supporting shaft 180 for the follower 40'. A second oblong hole 182 is formed in the block 174 to accommodate a retention screw 184 which engages a threaded hole 186 in the handle 38. A scale 188 is included to facilitate adjustment when the retention screw is loosened and the block 174 moved. In FIGS. 9, 10 and 11 an alternative means of mounting a cam 26' is shown. The cam 26' is slotted 190 at each end to engage threaded studs 192. Wing nuts 194 and washers 196 clamp the cam 26' to the studs 192 and bars 198 to which the studs are attached. Short links 200 are hinged at 202 to the bars 198 and hinged at 204 to retaining bars 206 in turn fastened beneath the table or bed plate 10 with screws 208 or other suitable means. Thus, cams 26' can be interchanged by loosening the wing nuts 194 or the fixture 32 can be lifted slightly to permit the cam 26' to be swung down underneath the bed plate 10 when not in use.

The location of the fixture 32 between a cam 26 or 26' and the grinding wheel 14 lessens the chance of grinding debri interference with the accurate movement of the followers 40 or 40' on the cam. Any collection of debri adjacent the cam is readily apparent to the operator and conveniently removed after temporarily lifting the cam out of position.

Figure 12:
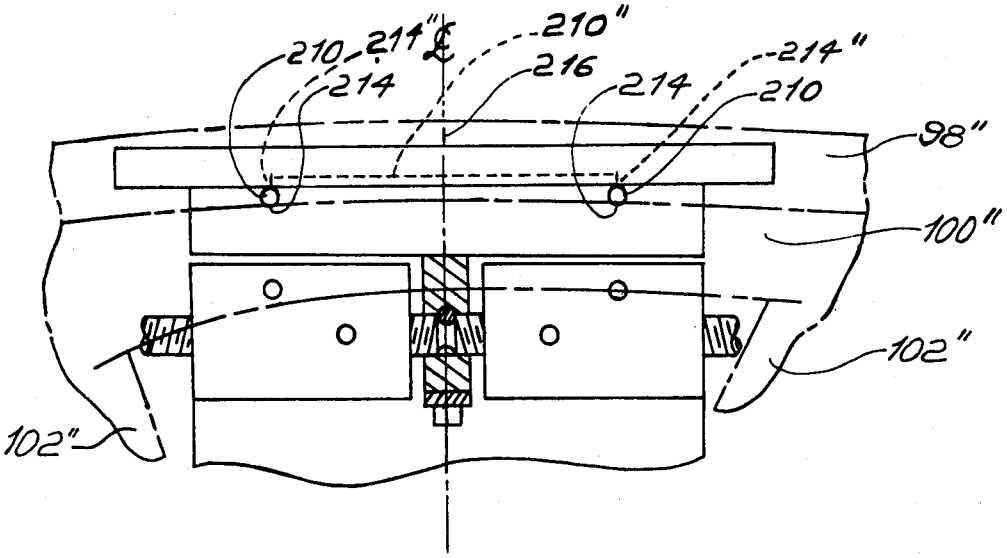
FIG. 12 is a partial cutaway plan view of the dowel blocks and lower jaw with a portion of a TUUK 2000 skate superimposed thereon.
Figure 13:
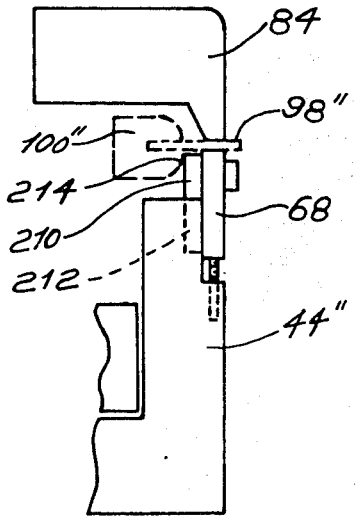
FIG. 13 is a partial cutaway side view of the upper and lower jaw and fixture with a portion of a TUUK 2000 skate superimposed thereon; and, FIG. 14 is a view of a scale for determining the equivalent center location on a hockey or figure skate of unconventional construction.

In FIGS. 12 and 13 a modification of the fixture is shown to accommodate the TUUK 2000 and other skates with unconventional supporting struts. Such skates have a molded plastic blade clamp 100" integral with the plastic struts 102". The blade clamp 100" is gently curved to substantially follow the sharpened contour of the blade 98". The fixture support 44" is modified by two dowel pins 210 removably inserted in holes or slots 212 behind the lower jaw 68. The lower lip 214 of the blade clamp 100" contacts the two dowel pins 210 to properly position the blade 98". Alternatively, the lower jaw 68 can be relieved to accommodate the curvature as shown by the dotted line 210" and alternate contact points 214" for the lip 214 provided integral with the jaw thus eliminating the dowels 210.

Figure 14:
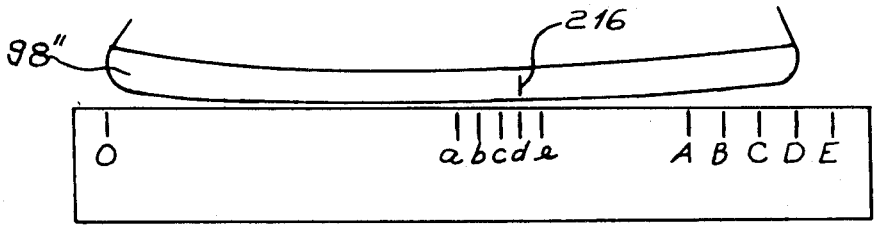

To obtain proper longitudinal centering of the skate a special scale as shown in FIG. 14 is used because the unconventional supporting struts 102" are not suitable locating means. The front of skate blade 98" is placed at "O" and the mark nearest the back of the blade, identified by one of the capital letters A through E, is determined. The mark with the corresponding lower case letter (e.g., "d") is 40% of the distance from the back of the blade toward the front of the blade. The 40% distance has been found to be the best equivalent center location for skates such as the TUUK 2000 currently on the market, however, such a scale could be constructed utilizing a different percentage. The 40% location is marked at 216 on the skate blade 98" and the skate located in the fixture such that the mark 216 coincides with the fixture centerline as shown in FIG. 12. The skate can then be clamped tightly and sharpened utilizing the fixture in the manner disclosed above for skates with conventional supporting struts.

I claim:

1. In an ice skate sharpening fixture having opposed jaws for retaining an ice skate therein, and follower means on said fixture, the ice skate having longitudinally curved blade clamp lips engaging the ice skate blade and an equivalent center location on the blade, and the fixture having a fixed centerline relative to the fixture follower means, the improvement comprising separate blade clamp lip locating means adjacent at least one jaw and equidistant from the fixture centerline, each of said separate blade clamp lip locating means not extending in a direction parallel to jaw clamping movement beyond the clamping surface of the jaw thereadjacent upon clamping an ice skate in said fixture, and said separate blade clamp lip locating means positioned to engage at least one of the blade clamp lips equidistant from the equivalent center location on the blade and adjacent the exposed portion of the blade.

2. The ice skate sharpening fixture of claim 1 wherein the separate blade clamp lip locating means comprise two dowel pins positioned to engage one blade clamp lip.

3. The ice skate sharpening fixture of claim 1 wherein the separate blade clamp lip locating means comprise two contact points on at least one jaw of the fixture, said jaw relieved between the contact points to provide clearance for the curvature of the blade clamp lip.

* * * * *